US007845026B2

(12) United States Patent
Brown

(10) Patent No.: US 7,845,026 B2
(45) Date of Patent: Dec. 7, 2010

(54) PORTABLE URINAL DEVICE

(76) Inventor: Judy A. Brown, 20363 E. 44th Ave., Denver, CO (US) 80249

( * ) Notice: Subject to any disclaimer, the term of this patent is extended or adjusted under 35 U.S.C. 154(b) by 581 days.

(21) Appl. No.: 11/773,906

(22) Filed: Jul. 5, 2007

(65) Prior Publication Data

US 2008/0028503 A1 Feb. 7, 2008

Related U.S. Application Data

(60) Provisional application No. 60/819,034, filed on Jul. 7, 2006, provisional application No. 60/822,139, filed on Aug. 11, 2006.

(51) Int. Cl.
*A47K 11/00* (2006.01)

(52) U.S. Cl. ..... 4/144.3; 4/144.4; 4/144.1

(58) Field of Classification Search ..... 4/144.1–144.4
See application file for complete search history.

(56) References Cited

U.S. PATENT DOCUMENTS

| | | | | |
|---|---|---|---|---|
| 1,928,170 | A | 1/1932 | Dwork | |
| 2,382,276 | A | 9/1942 | Wells | |
| 2,582,398 | A | 8/1948 | Siegenthal | |
| 3,473,172 | A | 10/1969 | Friedman et al. | |
| 3,711,871 | A | 1/1973 | Sherin | |
| 3,716,871 | A | 2/1973 | Borse | |
| 3,900,019 | A | 8/1975 | Logiadis | |
| 4,202,058 | A | 5/1980 | Anderson | |
| D265,586 | S * | 7/1982 | Sloan | D24/127 |
| D277,410 | S | 1/1985 | Floyd | |
| 4,568,339 | A | 2/1986 | Steer | |
| D286,569 | S | 11/1986 | Nakao et al. | |
| 4,665,571 | A | 5/1987 | Muccione | |
| D297,462 | S | 8/1988 | Meunchen | |
| 4,769,858 | A | 9/1988 | Gamm et al. | |
| 4,815,151 | A * | 3/1989 | Ball | 4/144.3 |
| D304,373 | S | 10/1989 | Floyd | |
| 5,285,532 | A * | 2/1994 | Sealy | 4/144.3 |
| 5,387,205 | A | 2/1995 | Cummins | |
| 5,406,651 | A | 4/1995 | Nogay | |
| 6,021,530 | A | 2/2000 | Davis | |
| D429,321 | S | 8/2000 | Gouget | |
| 6,151,721 | A | 11/2000 | Whitfield | |
| 6,183,454 | B1 * | 2/2001 | Levine et al. | 4/144.3 |
| 6,338,166 | B1 | 1/2002 | Hereford | |
| 6,370,701 | B1 * | 4/2002 | Siegrist | 4/144.1 |
| D497,981 | S | 11/2004 | Call | |
| 6,908,441 | B1 * | 6/2005 | Bernard et al. | 600/574 |

* cited by examiner

*Primary Examiner*—Khoa D Huynh
(74) *Attorney, Agent, or Firm*—Marsh Fischmann & Breyfogle LLP

(57) ABSTRACT

A portable urinal device that is particularly adapted to be used by a small child. The device includes a receptacle and a head member disposed on the receptacle, where the head member is placed beneath a user who can then urinate into the receptacle. The head member can include anterior side segments that are angled upwardly and are adapted to urge against the user's bladder to encourage urination. The device can advantageously be placed on a level surface so that the user can sits upon the head member. The device is useful when other bathroom facilities are not available and for potty-training a child.

10 Claims, 3 Drawing Sheets

PORTABLE URINAL DEVICE

CROSS-REFERENCE TO RELATED APPLICATIONS

This application claims priority to U.S. Provisional Patent Application Ser. No. 60/819,034, filed Jul. 7, 2006 and to U.S. Provisional Patent Application Ser. No. 60/822,139 filed Aug. 11, 2006. The disclosure of each of these applications is incorporated herein by reference in its entirety.

BACKGROUND OF THE INVENTION

1. Field of the Invention

The present invention relates to a portable urinal device, particularly one that is adapted to be used by a small child and is also useful as a training device for a small child.

2. Description of Related Art

Several portable urinal devices are disclosed in the prior art. Many of these devices are adapted to be used for specimen collection and/or for use by immobile patients that are restricted to a bed-ridden position.

There is a need for a urinal device that is portable and can be used, for example, when other accommodations are not readily available, such as in an automobile. It would be particularly useful if the device was adapted for use by small children and assisted urination by a small child in a simple and effective manner.

SUMMARY OF THE INVENTION

Accordingly, the present invention provides a urinal device. The device includes a receptacle, where the receptacle includes a top wall, a bottom wall and at least one sidewall to define an interior volume and to contain a liquid within the interior volume. The top wall has an aperture therethrough for receiving a liquid. The device also includes a head member attached to the top wall of the receptacle where the head member has an anterior portion, a posterior portion and an aperture disposed between the anterior and posterior portions. The anterior portion includes a peripheral edge, where the peripheral edge includes spaced apart side segments and an anterior edge segment and at least a portion of the side segments extend upwardly relative to the horizontal plane of the head member and in a direction away from the aperture, where the side segments are adapted to urge against the bladder of a user during use of the device. The posterior portion includes a posterior peripheral edge including spaced apart side segments and a posterior edge segment. The head member aperture is adapted to provide fluid communication with the receptacle during use.

The head member aperture can include threads disposed on an inner surface of the aperture and the device can further include a threaded plug that is adapted to be inserted into the aperture, engaging the threads to seal liquid within the receptacle. In one aspect, the receptacle has four sidewalls and a substantially rectangular cross-section.

In another aspect, the bottom wall of the receptacle is disposed beneath the head member, whereby a user can sit upon the head member when the bottom wall is placed on a level surface. In this regard, the bottom wall of the receptacle can lie in a plane that is substantially parallel with said horizontal plane of said head member.

According to another aspect, the width between the side segments of the anterior portion is wider than the width between the side segments of said posterior portion. According to yet another aspect, the side segments of the anterior peripheral edge comprise convex curved portions that are adapted to urge against the bladder of a user.

The urinal device of the present invention provides a fast and efficient means for a user, particularly a female user, to urinate when other accommodations are not immediately available. The device is particularly useful as a urinal and potty training device for a small child. In this regard, the side segments on the peripheral edges of the head member can be urged against the bladder of the child during use, causing the child to urinate.

DESCRIPTION OF THE INVENTION

The present invention will now be described with respect to the attached figures.

Figure 1:
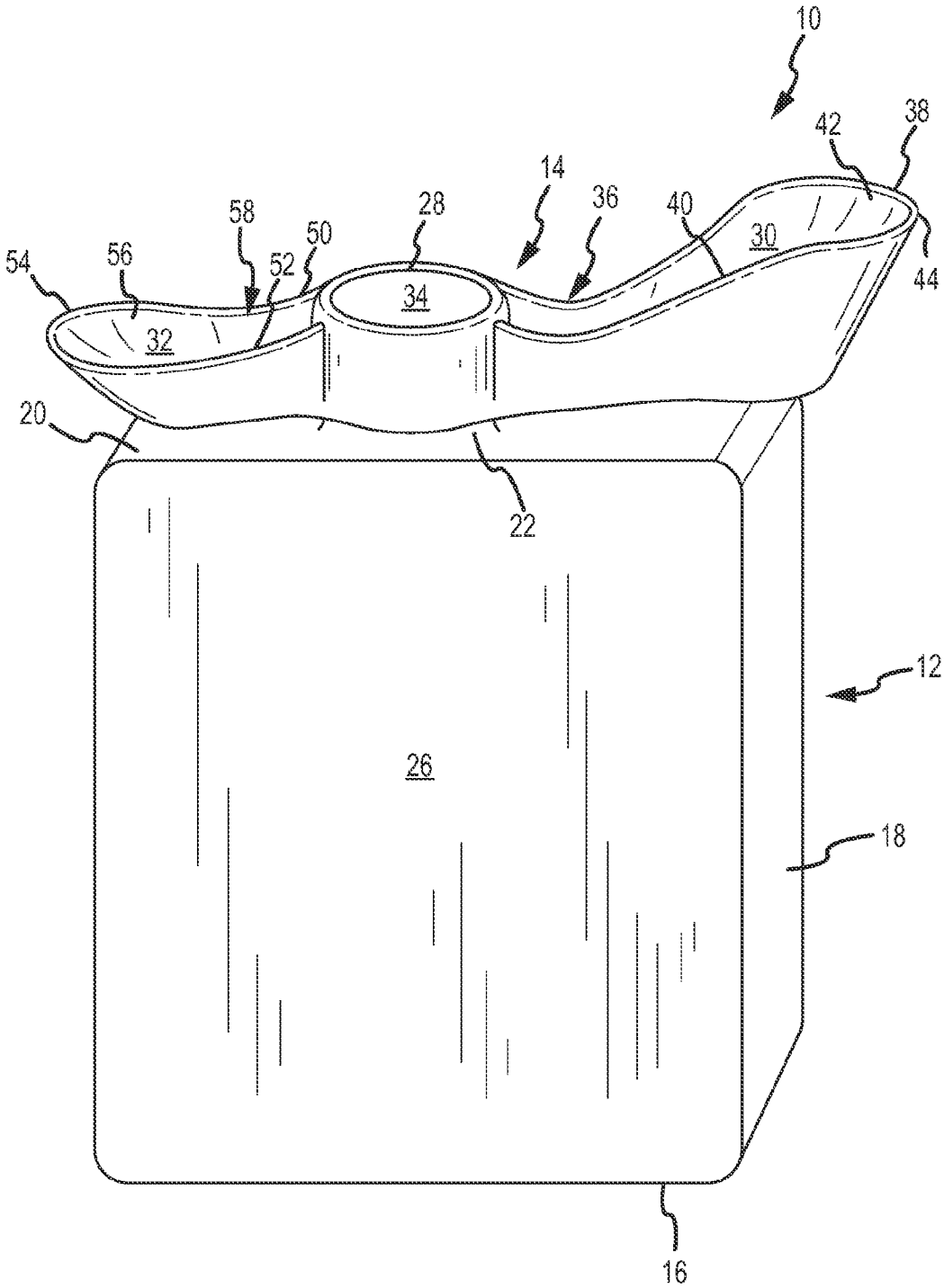
FIG. 1 illustrates a perspective view of a urinal device according to an embodiment of the present invention.

FIG. 1 illustrates a perspective view of a urinal device 10 according to an embodiment of the present invention. The urinal device 10 includes a receptacle 12 and a head member 14 that can be attached to a top wall 20 of the receptacle 12 for use. The head member 14 can be removably attached to the receptacle 12, such as by using a threaded connection, or can be permanently attached to the receptacle.

Figure 2:
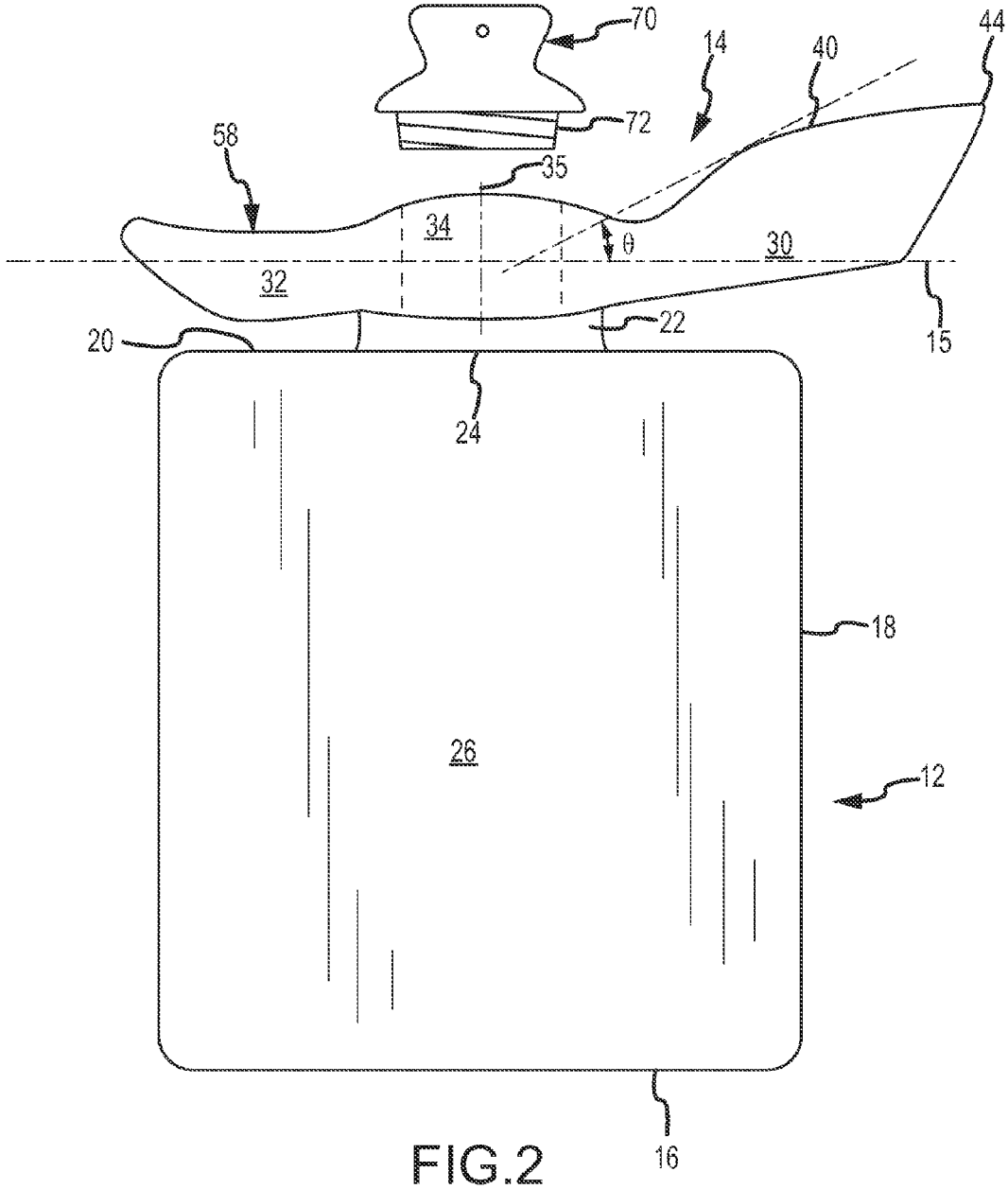
FIG. 2 illustrates a side view of a urinal device according to an embodiment of the present invention.

The receptacle 12 can be of any useful configuration including at least one sidewall, and in a preferred embodiment is substantially rectangular in shape (i.e., a rectangular cross-section) having 4 sidewalls (e.g., sidewall 18) and bottom wall 16 as is illustrated in FIG. 1. The receptacle also includes a top wall 20 having an aperture 24 therethrough (FIG. 2). The walls of the receptacle 12 define an interior space 26 that is adapted to hold a liquid, such as the urine of a user. In a preferred embodiment, the bottom wall 16 comprises a substantially flat surface so that the receptacle can be placed upright on a level surface. In this regard, the bottom wall 16 is disposed beneath the head member 14 such that the horizontal plane 15 of the head member is oriented substantially parallel with the bottom wall 16 and the user can sit upon the head member 14 when the bottom wall is placed on a level surface. The receptacle 12 can be fabricated from any useful material and in a preferred embodiment is fabricated from plastic, such as a molded high density polyethylene. Preferably, the receptacle 12 is rigid to enable it to be placed on a surface and support the head member 14.

The receptacle aperture 24 can be defined by a substantially cylindrical neck portion 22 that extends upwardly from the top wall 20 and is disposed between the head member 14 and the receptacle 12. The head member 14 can also be mounted directly on the top wall 20 such that the aperture 34 in the head member is aligned over the aperture 24 in the receptacle.

The head member 14 includes an anterior portion 30 and a posterior portion 32, with the aperture 34 disposed therebetween. The anterior portion 30 can include a peripheral edge 36 having spaced-apart side segments 38 and 40 and an anterior edge segment 44. A concave surface 42 extends downwardly from the peripheral edge 36. The spaced-apart side segments 38 and 40 each extend upwardly at a angle relative to the horizontal plane 15 of the head member 14, which lies substantially orthogonal to the vertical axis 35 of the aperture 34. The side segments 38 and 40 are angled upwardly in a direction away from the aperture 34 and toward the anterior edge 44 and each side segment can include a convex curved portion along its length. The convex curved portions of the peripheral edge 36 are advantageously adapted to urge against the bladder of a user during use and encourage urination, particularly when used with a small child.

The aperture 34 is defined by a sidewall 28 that can be substantially circular and can extend upwardly above the concave surfaces, and preferably extends above the peripheral edges of the anterior and posterior portions where those edges meet the aperture 34. Thus, the aperture sidewall 28 can be pressed up against a female user to completely surround the urethra during use and prevent leakage.

The posterior portion 32 includes a peripheral edge 58 having spaced-apart side segments 50 and 52 and a posterior edge segment 54. A concave surface 56 can extend downwardly from the peripheral edge 58.

Each of the peripheral edges 36 and 58 is preferably rounded and contoured to provide comfort for the user. That is, the peripheral edges 36 and 58 preferably have a rounded top-edge shape to minimize chafing and discomfort to the user when the device is placed against the user. The peripheral edges 36 and 58 can be fabricated from any material that provides a comfortable surface for the user. For example, the peripheral edges can comprise a rounded rubber edge.

Referring particularly to FIG. 2, it can be seen that the anterior portion 30 of the head member 14, particularly the side segments 38 and 40, extends vertically upward (that is, at a slightly upward angle Θ) relative to the horizontal plane 15 of the head member 14, so that when the head member 14 is pressed up against a user, particularly a small child, the side segments 38 and 40 will urge against the bladder of the user, thereby encouraging urination. FIG. 2 also illustrates a threaded plug 70 that includes threads 72 that are adapted to mate to internal threads contained in the aperture 34 of the head member 14. In this manner, the receptacle 12 can be sealed after use.

Figure 3:
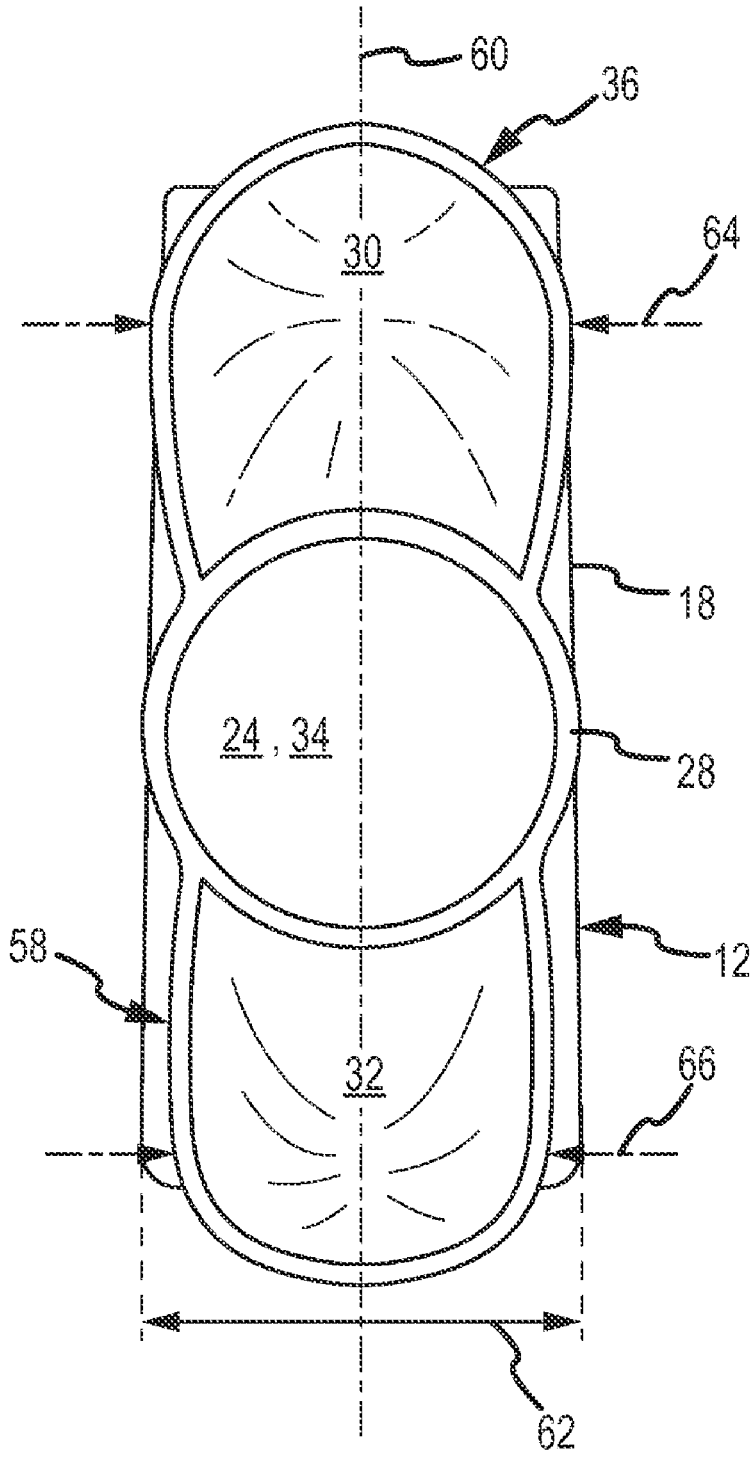
FIG. 3 illustrates a top view of a urinal device according to an embodiment of the present invention.

As is illustrated in the top view of FIG. 3, when the head member 14 is mounted on the receptacle 12, it is preferred that the longitudinal axis 60 of the head member 14 is aligned substantially perpendicular to the axis of the minor width 62 of the receptacle 12. In this manner, the device 10 can be easily placed under a user, particularly a small child. The width 64 of the anterior portion 30 (between opposed side segments) is preferably wider than the width 66 between the side segments of the posterior portion 32.

In one embodiment, to accommodate use of the device by a small child, the minor width 62 of the receptacle is not greater than about 3 inches and preferably is not greater than about 2 inches.

In use, a small child can place the head member 14 between her legs with the aperture 34 in the head member centered below the urethra while standing, squatting or sitting for spill proof, no leakage use. The rigid construction of the receptacle 12 and the orientation of the receptacle directly beneath the head member 14, advantageously enables a child to sit and balance on the device when the device is placed on a stable surface. The device can be small enough to fit into a diaper bag, stroller bag or other storage case. After use, the threaded plug can be inserted into the aperture to secure the contents from leakage until they can be discarded. The plastic can be made from a variety of different colors for personal use and can be provided with a plastic carrying bag made of the same color as the urinal device. The portable urinal device is particularly useful in times of emergencies when no other facilities are available.

While various embodiments of the present invention have been described in detail, it is apparent that modifications and adaptations of those embodiments will occur to those skilled in the art. However, is to be expressly understood that such modifications and adaptations are within the spirit and scope of the present invention.

What is claimed is:

1. A urinal device, comprising:

(a) a rigid receptacle, said receptacle comprising a top wall, a bottom wall and at least one sidewall defining an interior volume, the top wall having an aperture therethrough, wherein said receptacle is adapted to hold a liquid within the interior volume; and (b) a head member mounted directly on the top wall of the receptacle, said head member having a horizontal plane and comprising an anterior portion, a posterior portion and an aperture disposed therebetween, wherein (i) said anterior portion comprises an anterior peripheral edge and an anterior concave surface extending downwardly from said anterior peripheral edge, said anterior peripheral edge comprising spaced-apart side segments and an anterior edge segment, wherein at least a portion of the peripheral edge side segments extend at an upward angle relative to the horizontal plane of the head member and toward the anterior edge segment, wherein the side segments are adapted to urge against the bladder of a user during use of the device, (ii) said posterior portion comprises a posterior peripheral edge comprising spaced-apart side segments and a posterior edge segment and a posterior concave surface extending downwardly from said posterior peripheral edge, and (iii) said aperture comprises an aperture sidewall that extends upwardly above said anterior peripheral edge and said posterior peripheral edge where said anterior peripheral edge and said posterior peripheral edge meet said aperture sidewall and wherein said head member aperture is aligned with said top wall aperture to provide fluid communication with said receptacle during use.

2. A urinal device as recited in claim 1, wherein said head member aperture comprises threads disposed on an inner surface thereof, and said urinal device further comprising a threaded plug adapted to be inserted into said head member aperture to seal said receptacle.

3. A urinal device as recited in claim 1, wherein said receptacle comprises four sidewalls and a substantially rectangular cross-section.

4. A urinal device as recited in claim 1, wherein said bottom wall of said receptacle is disposed directly beneath said head member, whereby a user can sit upon said head member when said bottom wall is placed on a level surface.

5. A urinal device as recited in claim 4, wherein said bottom wall of said receptacle lies in a plane that is substantially parallel with said horizontal plane of said head member.

6. A urinal device as recited in claim 1, wherein the width between said side segments of said anterior portion is wider than the width between said side segments of said posterior portion.

7. A urinal device as recited in claim 1, wherein said side segments of said anterior peripheral edge each comprise convex curved portions along the length of the side portions that are adapted to urge against the bladder of a user.

8. A urinal device, comprising:

(a) a receptacle, said receptacle comprising a top wall, a bottom wall and at least one sidewall defining an interior volume, the top wall having an aperture therethrough, wherein said receptacle is adapted to hold a liquid within the interior volume; and (b) a head member attached to the top wall of the receptacle, said head member having a horizontal plane and comprising an anterior portion, a posterior portion and an aperture disposed therebetween, wherein (i) said anterior portion comprises an anterior peripheral edge, and an anterior concave surface extending downwardly from said anterior peripheral edge, said anterior peripheral edge comprising spaced-apart side segments and an anterior edge segment, wherein at least a portion of the peripheral edge side segments extend at an upward angle relative to the horizontal plane of the head member and toward the anterior edge segment, wherein the side segments each comprise convex curved portions along a length of the side portions that are adapted to urge against the bladder of a user during use of the device, (ii) said posterior portion comprises a posterior peripheral edge comprising spaced-apart side segments and a posterior edge segment, and a posterior concave surface extending downwardly from said posterior peripheral edge, and (iii) said aperture comprises an aperture sidewall that extends upwardly above said anterior peripheral edge and said posterior peripheral edge where said anterior peripheral edge and said posterior peripheral edge meet said aperture sidewall and wherein said head member aperture is aligned with said top wall aperture to provide fluid communication with said receptacle during use.

9. A urinal device as recited in claim 8, wherein said receptacle is a rigid receptacle.

10. A urinal device as recited in claim 9, wherein said head member is mounted directly on said top wall of said receptacle.

* * * * *